United States Patent [19]

Aikman

[11] 4,197,163

[45] Apr. 8, 1980

[54] COKE OVEN DOOR

[76] Inventor: Thomas C. Aikman, 106 Rosewood Ave., Beaver Falls, Pa. 15010

[21] Appl. No.: 921,950

[22] Filed: Jul. 5, 1978

[51] Int. Cl.[2] ..... C10B 25/06; C10B 45/00

[52] U.S. Cl. ..... 202/248; 202/263

[58] Field of Search ..... 202/222, 223, 242, 247, 202/248, 263

[56] References Cited

U.S. PATENT DOCUMENTS

| | | | |
|---|---|---|---|
| 2,855,347 | 10/1958 | Allan-Jones | 202/248 |
| 3,505,174 | 4/1970 | Peterson et al. | 202/248 |
| 3,629,094 | 12/1971 | Silverblatt | 202/248 |
| 4,118,284 | 10/1978 | Bowman et al. | 202/248 |

FOREIGN PATENT DOCUMENTS

| | | | |
|---|---|---|---|
| 2317581 | 10/1974 | Fed. Rep. of Germany | 202/248 |
| 967677 | 11/1950 | France | 202/248 |
| 1102059 | 6/1956 | France | 202/248 |

*Primary Examiner*—Michael S. Marcus

*Attorney, Agent, or Firm*—Martin J. Carroll

[57] ABSTRACT

A coke oven door for use in the end opening of a coking chamber having a generated gas outlet in its roof includes a plurality of plug sections each made of a hollow shell, preferably metal, having a vent through each side wall extending from the exterior of each section away from the outside of the coking chamber. Means are provided for fastening the sections to the frame in spaced apart relationship so that they can move vertically with respect to the door frame. The generated gases pass through the vents, up the flue formed by the hollow shells, out the top of the flue and into the generated gas outlet.

5 Claims, 2 Drawing Figures

COKE OVEN DOOR

This invention relates to a coke oven door and more particularly to such a door having an improved plug. It is common practice to have coke oven doors with a frame and a plug attached thereto which extends into the coke oven chamber. The most common types of plugs in use are made of refractory brick or cast refractory. These are relatively expensive to make, especially when considering their relatively short life. They also have the disadvantage that the end of the charge adjacent the door does not coke well so that green (uncoked) ends develop. These add tremendous emissions which pollute the air when the charge is pushed from the chamber. The evolved or generated gases, especially in the initial stages, create a positive pressure in the oven chamber because they do not escape readily. This prevents proper sealing of the oven door at this time.

In order to reduce the pressure in the coke oven chamber Cellan-Jones U.S. Pat. No. 2,855,347 dated Oct. 7, 1958 proposes a refractory plug having one or more vertical openings therein with side openings to the outside which extend from the vertical opening away from the door frame. While this construction no doubt helps relieve the pressure the plug has the other disadvantages of refractory plugs including its unitary construction. In addition the small size of the vertical opening which is necessary to maintain sufficient strength of the plug, restricts the flow is gases. Also the side openings are so directed that coal can easily enter into them causing partial or full blockage. Apparently the patentee recognizes these shortcomings because he proposes using additional vertical openings in the side walls of the coking chamber.

It has also been proposed to use metal plugs of various shapes such as shown in Coe U.S. Pat. No. 2,993,845 dated July 25, 1961. This plug consists of a single fabricated metal shell closed at the top and bottom to provide an enclosed cavity not open to the oven chamber in any way. It is necessary to provide insulation within the cavity to minimize heat loss. While this construction overcomes many of the disadvantages of refractory plugs it does nothing to overcome the door sealing problem nor the green end problem.

It is therefore an object of my invention to provide a coke oven door having a hollow metal plug providing a vertical flue with side openings so that generated gases can pass from the coking chamber to the top of the flue and into a roof outlet from the coking chamber.

Another object is to provide such a door in which the side openings extend away from the door opening and the exterior of the metal plug to prevent plugging of the openings by the coal.

Still another object is to provide such a door which is relatively inexpensive.

A further object is to provide such a door which permits expansion of the plug independent of the door frame.

Figure 1:
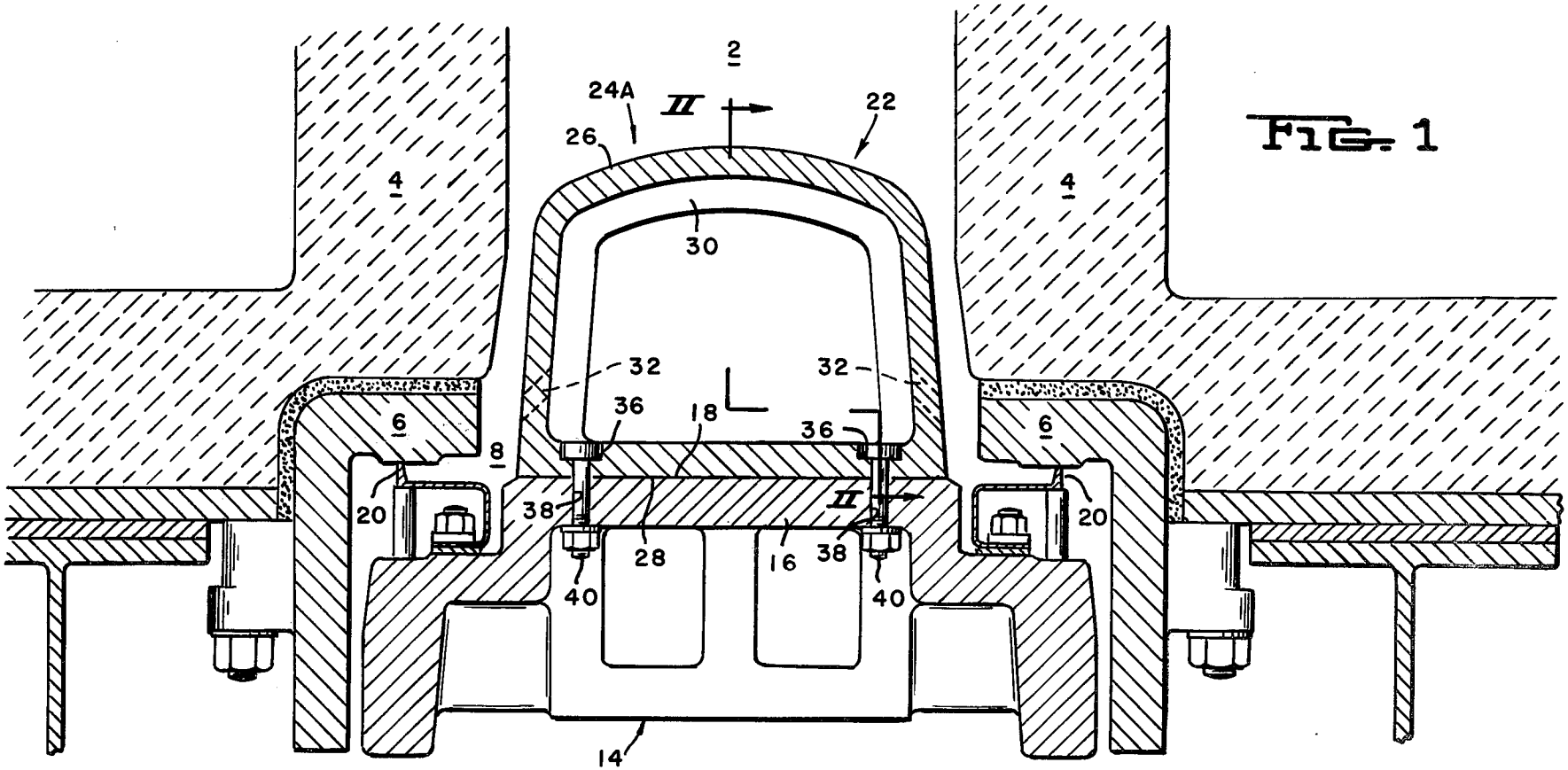
Figure 2:
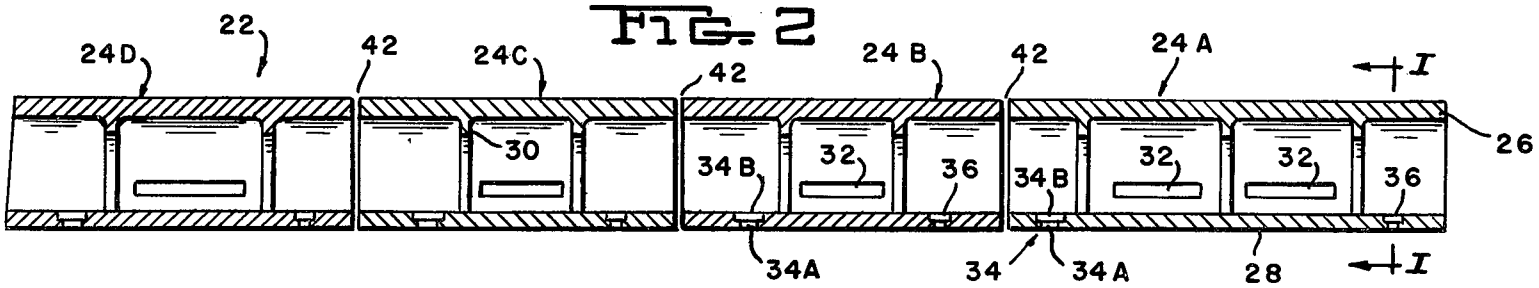

These and other objects will be more apparent after referring to the following specification and drawings in which:

FIG. 1 is a horizontal sectional view of the door of my invention taken on line I—I of FIG. 2; and FIG. 2 is a vertical sectional view of the door plug taken on line II—II of FIG. 1.

Referring more particularly to the drawings reference numeral 2 indicates one end of a coking chamber of a coke oven for coking coal. The chamber 2 is formed by refractory side walls 4 and has a door jamb 6 surrounding opening 8. An outlet for generated gases is provided in the roof of chamber 2 adjacent opening 8. An oven door frame 14 having a metal panel 16 with a flat inner face 18 is provided with a sealing ring 20 which contacts door jamb 6 in sealing engagement. The parts so far described are conventional.

According to my invention I provide a novel plug 22 which is attached to panel 16. Preferably the plug 22 is made in a plurality of sections shown as 24A, 24B, 24C and 24D. Since each section is of the same general construction only one top section 24A will be described in detail. Section 24A includes a hollow shell 26 having a flat surface 28 for contact with inner face 18 and reinforcing ribs 30 around the interior of the shell 26 except on the side having the flat surface 28. Vents or openings 32 are provided in the side walls of the shell 26. It will be seen that the vents 32 extend away from the surface 28 and the exterior of the shell 26 into the interior of the shell. Preferably the width of the opening 32 and the angle of slop is such that the outer end of the opening side remote from surface 28 and the inner end of the opening side towards surface 28 are approximately equal distance from the surface 28. A pair of slots 34 are provided adjacent the bottom of section 24A in the wall containing surface 28. As shown each slot 34 includes a vertically elongated outer portion 34A and a larger vertically elongated inner portion 34B. A pair of counterbored holes 36 are provided adjacent the top of section 24A in alignment with slots 34. Holes 38 are provided in panel 16 for receiving bolts 40 one associated with each slot 34 and hole 36 so as to secure the sections 24A, 24B, 24C and 24D to the door frame 14. It will be understood that the plug sections when installed cold have a space 42 therebetween. In use, the plug sections will expand due to heat more than the door frame, but the slots 34 permit relative movement of the plug sections with respect to the door frame.

The plug sections may be made of a ceramic refractory material, but are preferably made of a metal able to withstand the heat in the coking chamber such as cast iron or cast alloy iron.

It will be seen that the coke oven door of my invention includes a hollow plug movable with respect to the door frame and having a hollow flue extending from the bottom to the top. In all cases the flue has a top opening which may be provided by having its top open or by a hole through the side wall. The flue need not be open at its bottom on the pusher side of the coke chamber but there must be a bottom opening at all times. It will be seen that the wall of the plug is relatively thin to that there is a large flue area. The advantage of the sectional construction is to provide stress relief and to permit replacement of one section rather than the entire plug. It will be noted that the inner end of the plug is rounded and the radii should be to pressure vessel standards for long service. The re-inforcing ribs are advisable for added strength while still permitting good flow. While the plug could be made of one piece, the sectional design is stronger, better permits expansion and contraction and practically eliminates distortion of the door frame.

In one particular installation the metal plug has an overall height of 12'-10⅝" while the four sections total 12'-9⅛" leaving a distance of ½ inch between sections in the cold condition. Approximately 81 square inches of flue opening is provided with the side walls having a thickness of approximately 1 inch and the end walls a thickness of approximately 1½ inch.

In operation, the coking operation is basically the same as in the prior art. However, the evolved gases adjacent the door opening pass readily up through the plug vent or flue and pass out through the generated gas outlet. These gases pass from the coking chamber 2 through the vents 32 and openings 42 into the flue. This venting action reduces gas pressure in the coking chamber and on the door, thus providing better sealing action which in turn reduces pollution. The diagonal arrangement of vents 32 provides for maximum venting while greatly limiting the amount of coal that can enter the flue opening. While the vents 32 may be omitted I have found that they are very desirable to receive generated gases throughout the height of the oven. The openings 42 also are helpful in this respect.

I claim:

1. A coke oven door for use in the end opening of a coking chamber having a generated gas outlet in the roof thereof which comprises:

a door frame having a flat inner surface:

a metal plug including a hollow metal shell having side walls and an end wall having a flat surface for contacting said flat inner surface of said door frame, and a vent through at least one of said side walls, said vent extending from the outer surface to the inner surface of one of said side walls, the opening formed by said vent in the outer surface of said side wall being spaced closer to a plane extending through said flat inner surface of said door frame than the opening formed in the inner surface of said side wall; and means for fastening said plug to said frame;

said plug forming a vertical flue having a top opening whereby generated gases can pass through said vents, up said flue and into said generated gas outlet.

2. A coke oven door according to claim 1 in which said metal plug comprises a plurality of plug sections arranged end to end with a space therebetween when cold to permit lengthwise expansion thereof when heated, each section including a hollow metal shell having side walls and an end wall having a flat surface for contacting said flat inner door frame surface, and a vent through each side wall; and said means for fastening said plug to said frame includes means for separately fastening each of said plug sections to said frame with a space between adjacent plug sections and in such manner that the plug sections can move vertically with respect to said door frame.

3. A coke oven door according to claim 2 in which said means for fastening said plug sections to said frame includes a pair of holes adjacent one end of each section, a pair of vertically elongated slots adjacent the other end of each section, holes in said door frame aligned with each of said slots and holes in said plug sections, and bolts in said aligned holes.

4. A coke oven door for use in the end opening of a coking member having a generated gas outlet in the roof thereof which comprises:

a door frame having a flat inner surface;

a plurality of plug sections, each section including a hollow shell having a flat surface for contacting said flat inner door frame surface; and means for separately fastening each of said plug sections to said frame with a space between adjacent plug sections and in such manner that the plug sections can move vertically with respect to said door frame;

said means for fastening said plug sections to said frame including a pair of holes adjacent one end of each section, a pair of vertically elongated slots adjacent the other end of each section, holes in said door frame aligned with each of said slots and holes in said plug sections, and bolts in said aligned holes;

said assembled plug sections forming a vertical flue extending substantially the height of the door frame with top and bottom openings into said plug from said chamber whereby generated gases can pass through said bottom opening, up said flue and out of said bottom opening into said generated gas outlet.

5. A coke oven door according to claim 4 in which said metal plug is made of a metal of the class consisting of cast iron and cast alloy iron.

* * * * *